United States Patent [19]

Akashi

[11] 4,216,805

[45] Aug. 12, 1980

[54] WOVEN FASTENER STRINGER

[75] Inventor: Shunji Akashi, Kurobe, Japan

[73] Assignee: Yoshida Kogyo KK, Tokyo, Japan

[21] Appl. No.: 972,245

[22] Filed: Dec. 22, 1978

[30] Foreign Application Priority Data

Dec. 29, 1977 [JP] Japan ..... 52-5391

[51] Int. Cl.² ..... A44B 19/40

[52] U.S. Cl. ..... 139/384 B; 24/205.16 C

[58] Field of Search ..... 139/384 B; 24/205.1 C, 24/205.13 C, 205.16 C

[56] References Cited

U.S. PATENT DOCUMENTS

| | | | |
|---|---|---|---|
| 3,058,188 | 10/1962 | Yoshida | 24/205.1 C |
| 3,147,529 | 9/1964 | Wilcken | 24/205.16 C |
| 3,454,052 | 7/1969 | Burbank | 24/205.16 C |
| 3,474,505 | 10/1969 | Glindmeyer | 24/205.16 C |
| 3,524,479 | 8/1970 | Burbank | 139/384 B |
| 4,045,846 | 9/1977 | Moertel | 24/205.16 C |
| 4,100,656 | 7/1978 | Moertel | 24/205.16 C |

*Primary Examiner*—Henry Jaudon

*Attorney, Agent, or Firm*—Bucknam and Archer

[57] ABSTRACT

A woven fastener stringer has a row of successively interconnected coupling loops having a head, an upper leg, a lower leg and a heel. The row of loops is secured to a longitudinal edge of a stringer tape by a binding system comprising a plurality of binding warp threads and a plurality of relatively large diameter thermoplastic yarns, all extending longitudinally in the region of the heel of the loop. The thermoplastic yarns are elastically deformed to assume an outer peripheral surface configuration complimentary to inner guide walls of a slider to facilitate smooth running of the slider along the edge of the stringer.

3 Claims, 5 Drawing Figures

WOVEN FASTENER STRINGER

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a row of successive elongated loops or convolutions each having a coupling head, an upper and a lower leg and a connecting portion.

Most of the known fasteners, however, have failed to meet with the requirements for the success of the so-called woven slide fasteners which largely depends on one hand, upon the positional stability of the filament, i.e. coupling fastener element, with respect to the stringer tape against external stresses, and on the other hand, upon smooth coupling and uncoupling of the opposed stringers by the action of a reciprocating slider.

When the filament is formed into a row of helically coiled coupling loops and mounted on a stringer tape, such loops would usually present a cross-sectionally oval shape which is not complementary with the inner guide surfaces of a slider and hence would often interfere with the sliding movement of the latter during opening and closing of the fastener stringers. With a view to eliminating this difficulty, the coupling loops were covered by covering threads over their upper and lower surfaces including their heel portions in such a manner that the covered portions of the loops present a transverse cross section complimentary in shape with the guide channel of the slider, as typically disclosed in Japanese Patent Publication Nos. 38-20175 and 47-15373. However, such prior art devices have a common drawback in that due to the covering threads being soft and bulky in nature, the slider to be used for this type of stringer is required to be built slightly smaller than the over-all dimensions of the covered coupling loops taking into account the contraction of the covering threads which results from engagement with the slider. This in turn creates an increase in the resistance of the covering threads to sliding movement of the slider, resulting in disagreeable, sometimes interrupted coupling or uncoupling engagement of the cooperating stringers.

SUMMARY OF THE INVENTION

According to the invention, there is provided, a woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section and interengageable with another row on a mating stringer by the action of a slider, each of said loops having a coupling head at one end thereof, an upper leg and a lower leg extending from said head in a common direction, and a heel portion remote from said head connected to a next adjacent one of said successive loops; a binding system securing said loops to said filament section and comprising a plurality of thermoplastic yarns, one extending longitudinally of said tape in abutting engagement with the upper surface of said heel portion and the other extending longitudinally of said tape in abutting engagement with the lower surface of said heel portion and a binding weft thread continuing from said foundation weft thread and interwoven with said thermoplastic binding yarns, said thermoplastic binding yarns being elastically deformed to assume an outer peripheral surface complementary in shape with the inner guide walls of said slider and integrally joining adjacent ones of said heel portions.

It is therefore a primary object of the present invention to eliminate the foregoing difficulties encountered by the prior art devices.

A more specific object of the invention is to provide an improved fastener stringer which has a row of successive coupling loops firmly secured and properly aligned in place on a stringer tape.

Another related object of the invention is to provide an improved fastener stringer covering a row of coupling loops interengageable smoothly and effectively with another row of loops on a mating stringer in response to reciprocating movement of a slider.

These and other objects and features will be better understood from the following detailed description of a preferred embodiment taken in conjunction with the accompanying drawings.

BRIEF DESCRIPTION OF THE DRAWINGS

In the drawings wherein like reference numerals refer to like parts.

DETAILED DESCRIPTION OF THE PREFERRED EMBODIMENTS

Figure 1:
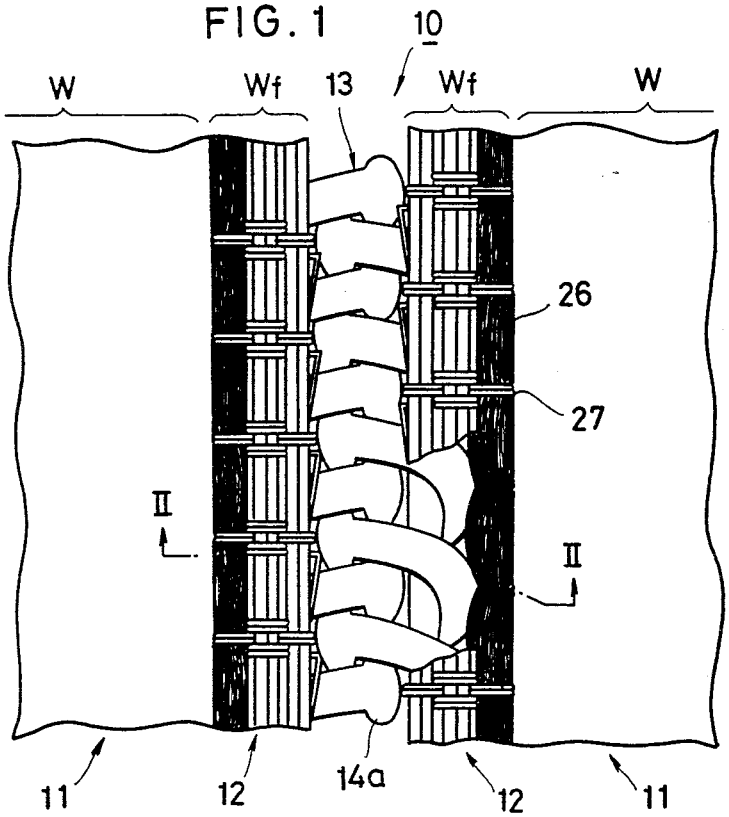
FIG. 1 is a plan view on enlarged scale of a portion of one of two identical stringers according to one embodiment of the invention.
Figure 2:
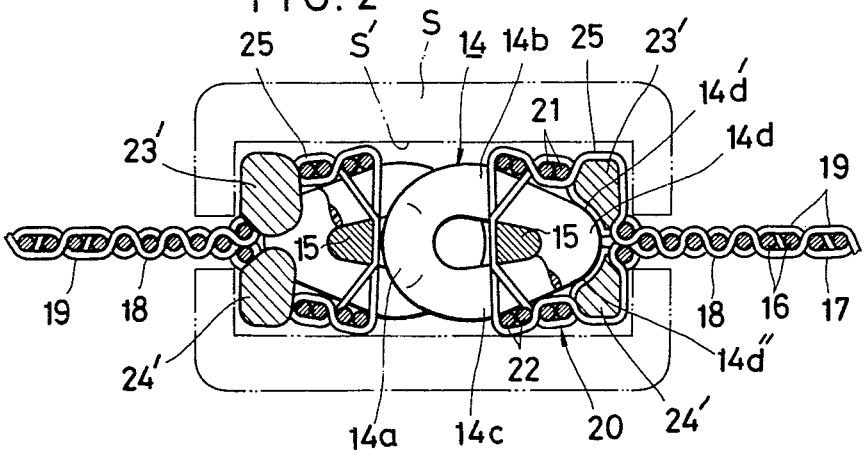
FIG. 2 is a transverse cross-sectional view taken on the line II—II of FIG. 1 with a slider mounted on the stringer.
Figure 3:
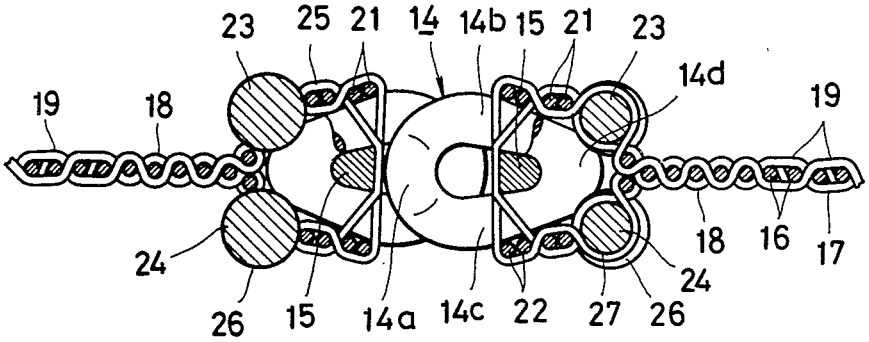
FIG. 3 is a transverse cross-sectional view of a stringer which appears prior to finishing according to the invention.

Referring now to FIGS. 1–3, which illustrate a first preferred embodiment of the invention, there is shown a fastener stringer generally designated 10 which constitutes one part of a pair or two identical stringers for a slide fastener. The stringer 10 consists of a generally flat web section W defining a major dimension of a woven tape 11 and a woven filament section $W_f$ defining a longitudinal edge portion 12 into which a filament 13 of plastic material is woven. The filament 13 is formed from a linear blank of a suitable plastic material into a helically coiled structure having a succession of loops or elongated convolutions during the course of weaving of the tape 11.

Each loop or elongated convolution 14 in the filament 13 has a coupling head **14*a* at one end thereof, an upper leg 14*b* and a lower leg 14*c* extending from the heat 14*a* in a common direction and a heel portion 14*d* remote from the head 14*a* connected to a next adjacent one of the successive loops 14. The coupling head 14***a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 1 and define therebetween a longitudinally extending "tunnel" or hollow conduit through which a reinforcing string, cord or core 15 is inserted.

The web section W of the tape 11 may be of any known design having foundation warp threads 16 and foundation weft thread 17 interwoven in a variety of patterns such as a combination of plain weave 18 and twill weave 19, as shown, which will require no further explanation as this has no direct bearing upon the invention.

The term "filament woven section $W_f$" is used to define a longitudinal edge portion of the tape 11 into which the filament 13 serving as a coupling element for a slide fastener is woven. The row of coupling loops 14 is secured to the filament woven section $W_f$ by a binding system 20 which comprises a first group of binding warp threads 21, a second group of binding warp threads 22, a plurality of relatively large diameter thermoplastic binding yarns 23,24 and a binding weft thread 25 which is a continuous portion of the foundation weft thread 17.

The first group of binding warp threads 21 extend longitudinally of the stringer tape 11 and overlie the upper legs 14*b* of successive loops 14 adjacent to the heel portions 14*d*. The second group of binding warp threads 22 extend longitudinally of the stringer tape 11 and underlie the lower legs 14*c* of successive loops 14 adjacent to the heel portions 14*d*. One of the thermoplastic binding yarns 23, (24) extends longitudinally of the stringer tape 11 in abutting engagement with the upper surface 14*d'* of the heel portion 14*d* of each loop 14, and the other binding yarn 24 extends longitudinally of the stringer tape 11 in abutting engagement with the lower surface 14*d''* of the heel portion 14*d*. The binding weft thread 25 is passed around and in interlaced relation to the first and second groups of binding warp threads 21,22 and the thermoplastic binding yarns 23,24 and bind all of these warp materials together into an integral binding system securing the row of coupling loops 14 via cord 15 to the woven filament section $W_f$ of the tape 11.

The thermoplastic binding yarns 23,24 are compressed where these are interlaced or interwoven with the weft thread 25, with resultant swollen portions 26 alternating at intervals with compressed portion 27 along the length of the yarns 23,(24), as better shown in FIG. 3 in which the yarns 23,24 at the left-hand side represent the respective swollen portions 26 and those at the right-hand side represent the respective compressed portions 27.

In accordance with the invention, the thermoplastic binding yarns 23,24 are subjected to thermal compression molding with use of a suitable die having such a working surface that the mass of the yarns 23,24 is elastically deformed to assume an outer peripheral surface complimentary in shape with the inner peripheral guide walls S' of a slider S as shown in FIG. 2. Elastically deformed mass 23',(24') penetrates into the spaces defined by the heel portions 14*d* between each adjacent pair of loops 14 and joins adjacent heel portions 14*d* together, so that the heel portions 14*d*, which would otherwise be movable relative to adjacent ones of successively interconnected loops 14 in a row, are held integrally together. Thus the swollen or laterally extending portions 26 penetrate into respective spaces defined between heel portions 14*d* between each adjacent pair of loops 14 to restrain said heel portions 14*d* against relative movement. This ensures not only firm fixation of the row of loops 14 to the tape 11, but also smooth, effective coupling and uncoupling operation of the two opposed stringers 10 as the neutral zone of each loop 14 which is free of both compressive and tensile stresses is maintained in close proximity to the heel portion 14*d* remote from the coupling head 14*a* so as to create an increased free area in each loop available for coupling engagement with adjacent loops.

Figure 5:
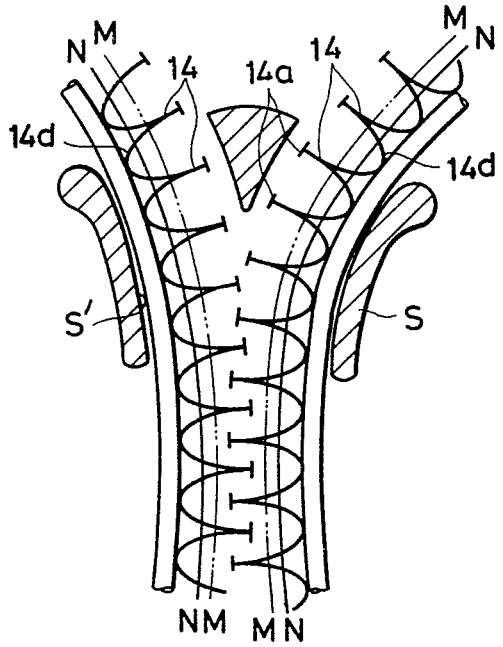
FIG. 5 is a diagrammatic view illustrating the operation of a slide fastener.

FIG. 5 is utilized to explain the behaviour of the respective rows of coupling loops 14, in which a solid line N represents the position of the neutral zone of each of successive loops 14 which lies close to the heel portion 14*d* according to the invention, and a chain-dotted line M represents the position of the neutral zone of the prior art loops which is shifted closely toward the coupling head 14*a*.

Figure 4:
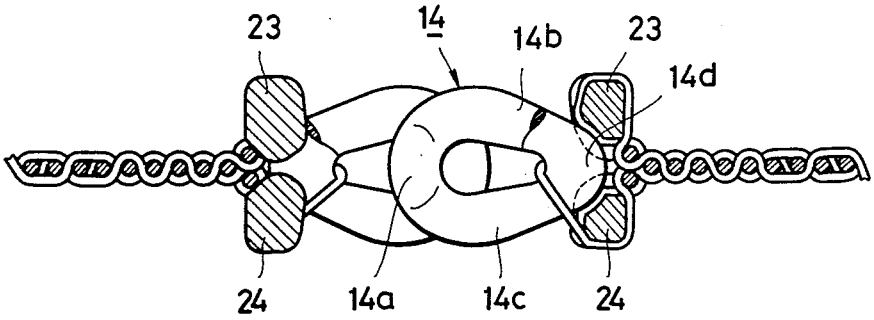
FIG. 4 is a transverse cross-sectional view of a stringer according to another embodiment of the invention.

FIG. 4 shows a second embodiment of this invention which is substantially the same as the first embodiment already described, except for the omission of binding warp threads 21,22 and cord 15. This modification provides basically the same function and results in so far as the heel portions 14*d* between each adjacent pair of loops 14 are integrally joined together by elastically deformed mass of the thermoplastic binding yarns 23,24.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A woven fastener stringer comprising a woven tape formed with foundation warp and weft threads comprising a web section defining a major dimension of said tape and a woven filament section defining a longitudinal edge portion of said tape; a row of successively interconnected elongated loops woven into said filament section and interengageable with another row on a mating stringer by the action of a slider, each of said loops having a coupling head at one end thereof, an upper leg and a lower leg extending from said head in a common direction, and a heel portion remote from said head connected to a next adjacent one of said successive loops; a binding system securing said loops to said filament section and comprising a pair of thermoplastic yarns, one extending longitudinally of said tape in abutting engagement with the upper surface of said heel portion and the other extending longitudinally of said tape in abutting engagement with the lower surface of said heel portion and a binding weft thread continuing from said foundation weft thread and interwoven with said thermoplastic binding yarns, said thermoplastic binding yarns being deformed to assume a compressed configuration in which such yarns each have an outer peripheral surface complementary in shape with respective inner guide walls of said slider and have laterally extending portions that penetrate into respective spaces defined by the heel portions between each adjacent pair of said loops to restrain said heel portions against relative movement.

2. A woven fastener stringer as defined in claim 1 wherein said binding system includes a first group of binding warp threads extending longitudinally of said tape in overlying relation to the upper legs of said loops adjacent to said heel portions, and a second group of binding warp threads extending longitudinally of said tape in underlying relation to the lower legs of said loops adjacent to said heel portions, said first and second groups of threads being interwoven with said binding weft thread.

3. A woven fastener stringer as defined in claim 1 or 2, wherein said thermoplastic binding yarns are elastically deformed to penetrate into the spaces defined by said heel portions between each adjacent pair of said loops.

* * * * *